United States Patent [19]

Perry

[11] 4,240,371

[45] Dec. 23, 1980

[54] SIGNAL BLADDER

[76] Inventor: Theodore M. Perry, P.O. Box 8854, Auckland, New Zealand

[21] Appl. No.: 68,324

[22] Filed: Aug. 17, 1979

[30] Foreign Application Priority Data

Aug. 28, 1978 [NZ] New Zealand ..... 188264

[51] Int. Cl.[3] ..... B63B 45/00; G09B 5/00

[52] U.S. Cl. ..... 116/210; 9/9

[58] Field of Search ..... 116/209, 210, 211, DIG. 9; 9/9

[56] References Cited

U.S. PATENT DOCUMENTS

| | | | |
|---|---|---|---|
| 2,418,397 | 4/1947 | Collyer et al. | 116/211 X |
| 2,569,977 | 10/1951 | Dickinson | 9/9 |
| 2,830,309 | 4/1958 | Lawson | 116/210 X |
| 3,746,285 | 7/1973 | Mango | 116/210 |
| 3,874,325 | 4/1975 | Cocker | 116/210 |
| 4,042,882 | 8/1977 | Camacho et al. | 116/210 X |
| 4,080,677 | 3/1978 | Koehler | 9/9 |

FOREIGN PATENT DOCUMENTS

| | | | |
|---|---|---|---|
| 2383830 | 10/1978 | France | 116/210 |
| 607926 | 12/1978 | Switzerland | 116/210 |

*Primary Examiner*—Daniel M. Yasich

*Attorney, Agent, or Firm*—Browdy and Neimark

[57] ABSTRACT

A signalling device for underwater divers, in the form of an inflatable bladder held within a container and attached to a reel. The device can be attached to a diver, being strapped to his arm or to his air tank, for example. The device can be actuated by pulling a handle, which releases a gas cartridge to inflate the bladder as it is simultaneously released from the container to float to the surface. Rescuers can then follow the line down to the reel to locate the diver.

4 Claims, 1 Drawing Figure

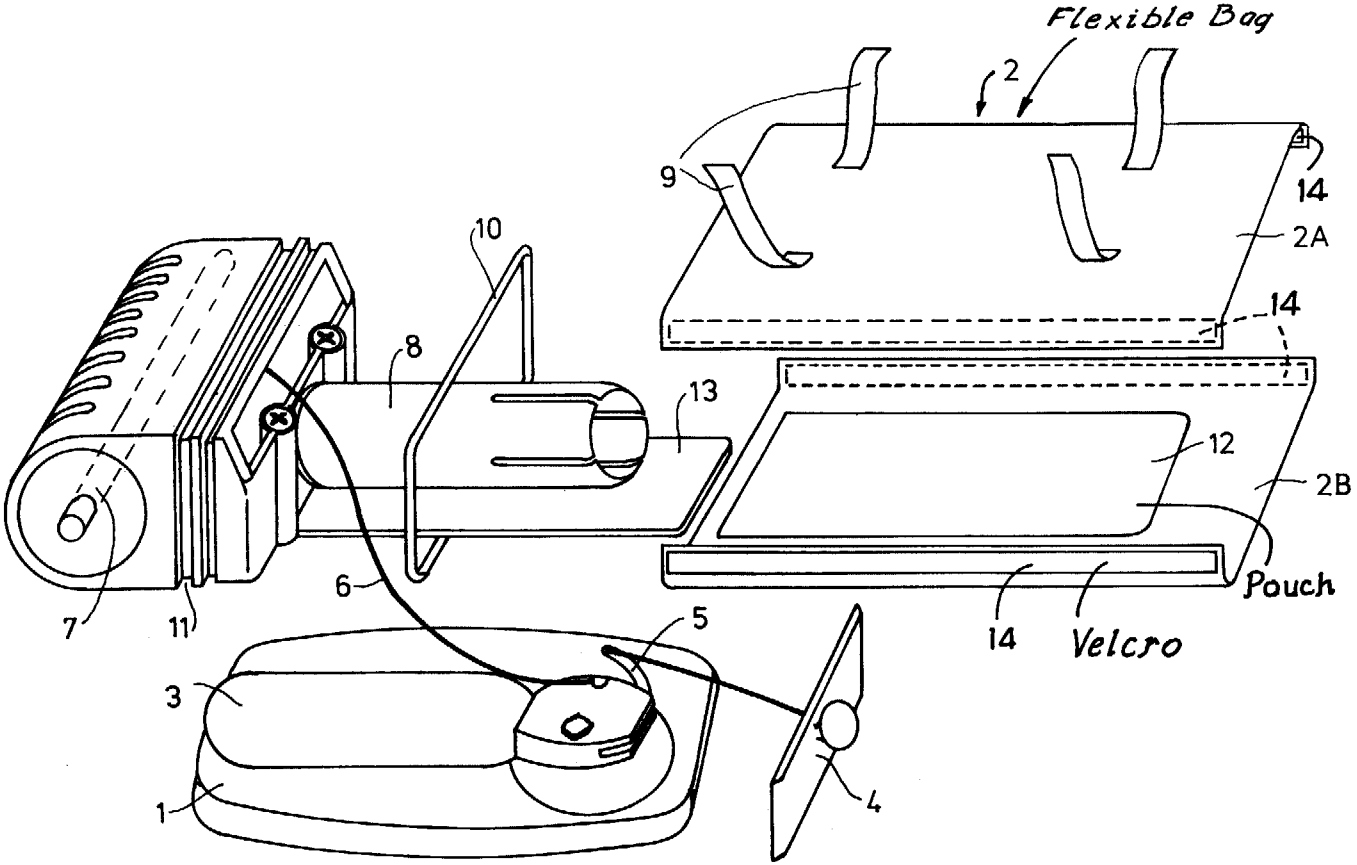
Flexible Bag
2
14
2A
14
2B
Pouch
12
Velcro
14
4
9
13
5
10
8
6
11
3
1
7

SIGNAL BLADDER

SUMMARY OF THE INVENTION

The present invention relates to a signal bladder with which an undersea diver can signal observers on the water surface.

In the past, divers have perished because they have gotten into difficulties, but by the time any alarm was raised it was already too late. If any such diver had had a means of signalling the surface, it may well have been possible to rescue him within a few minutes of his being entangled or lapsing into unconsciousness, so that people on the surface could have sent down one or more rescuers to retrieve the diver and, if necessary, resuscitate him.

The object of the present invention is to provide a simple means of sending a signal to the water surface if and when a diver experiences difficulties and requires assistance.

The present invention broadly consists in a signalling device comprising an inflatable bladder removably held within a container, a gripping means at one end of the container and adapted to be grasped by a hand and removed from the container, a supply of compressed gas connected to the bladder and the gripping means such that upon removal of the said gripping means, the gas can enter the bladder to inflate it, and a flexible line connected at one end to the bladder and at the other to a line storage means.

BRIEF DESCRIPTION OF THE DRAWING

The above gives a broad description of the present invention, one preferred form of which will now be described with reference to the accompanying drawing which is an exploded perspective view of the preferred signalling device.

DESCRIPTION OF THE PREFERRED EMBODIMENT

In the preferred form of the present invention the signalling device comprises an inflatable bladder 1, preferably colored bright yellow or orange or any similar color in order that it be readily visible at the water surface. The bladder is held within a flexible bag 2, which also holds a $CO_2$ cartridge 3 connected to the bladder. Thus, removal of a handle 4 which covers the open end of the bag pulls a lever 5 to which it is connected to trigger the $CO_2$ cartridge to inflate the bladder and release the bladder from the bag. The inflation of the bladder causes the two halves 2A, 2B of the bag, which are preferably held together by strips of hooking material 14, such as that sold under the name Velcro, to break away from each other. A flexible line or cord 6 connects the bladder to a spool 7. The cartridge 3 typically is releasably held by a cartridge holder 8 pivotally fixed to the housing of the spool 7.

The bag is preferably provided with straps 9 so that the device can be attached to the diver, typically to his upper arm, although it can be attached to any convenient part of the diver's body or equipment. Instead of the straps 9 there may be a stainless steel clip or other device for attaching the device to a diver's belt or harness.

A flexible loop 10 is typically provided for holding the end of the bag 2 to a channel 11 in the housing of the reel 7. The bag may also have a pouch 12 into which a tongue 13 on the reel housing fits.

In use, the unit is attached to a diver so that should he experience difficulties he can simply remove the handle from the bag. Thus the bladder is inflated by the $CO_2$ cartridge and becomes buoyant, and thus heads towards the water surface. As soon as the bladder is spotted by observers at the water surface, rescuers can be sent down to give the required assistance to the diver.

If desired the device, instead of being attached directly to the diver or his equipment, can be attached to a separate anchor which is also released when the handle 4 is pulled.

By having a separate anchor so that the triggered device is entirely free of the diver's body he is unencumbered thereby. It would, however, be unusual for the diver to be swept very far from the device in the time that would normally be taken for observers to send a rescuer down to find him. In most, if not all, cases, a rescuer following the flexible line down from the bladder ought to find the diver who released it not far from the line.

This arrangement is, however, less preferred.

The signalling device of the present invention may also be used as a marker to identify a particular spot in the sea. If a diver finds something on the sea floor which he will wish to return to on a later occasion he can simply attach the signalling device to the object and release the bladder to mark the spot. Also, if someone on the surface wishes to mark the spot he can simply release a signalling device attached to an anchor and drop it overboard. It will then act as a buoy.

Modifications to the above are permissible within the scope of the present invention as broadly defined. For example, the source of compressed gas need not necessarily be a $CO_2$ cartridge but could be any appropriate gas supply or gas generator. It may for example, be possible to have the bladder inflated from the diver's own air supply, although such an arrangement would be less preferable in cases where the diver experiences difficulties when his air supply is low.

Instead of being held within a flexible bag 2 the device may be housed in a rigid container of steel or plastic, open at one end so that when the device is triggered there is no impediment to the release of the bladder as it is being inflated. In such an arrangement, however, the handle should be connected directly to the bladder so that when the handle is pulled the bladder comes out with it to minimize the possibility that the bladder may become jammed in the container through being inflated before it is released from the container.

What I claim is:

1. A signalling device for divers, comprising:

an inflatable bladder;

container means for removably holding said bladder, said container means comprising a flexible bag formed in two separable halves held together by a releasable securing means comprising strips of hooking material;

gripping means at one end of said container means for being grasped by a hand and removed from said container means;

compressed gas supply means connected to said bladder and said gripping means for supply of compressed gas to inflate said bladder upon removal of said gripping means;

line storage means for storing a flexible line;

a flexible line connected at one end to said bladder and at the other end to said line storage means; and attaching means for attachment of the device to a diver's body or equipment and comprising flexible straps.

2. A signalling device in accordance with claim 1, further including holder means, pivotally attached to said line storage means, for releaseably holding said compressed gas supply means.

3. A signalling device as claimed in claim 1 wherein the line storage means comprises a reel.

4. A signalling device as claimed in claim 1 wherein said compressed gas supply means comprises a $CO_2$ cartridge.

* * * * *